United States Patent [19]

Uhri et al.

[11] Patent Number: 4,834,181

[45] Date of Patent: May 30, 1989

[54] CREATION OF MULTI-AZIMUTH PERMEABLE HYDRAULIC FRACTURES

[75] Inventors: Duane C. Uhri, Grand Prairie; Alfred R. Jennings, Jr., Plano, both of Tex.

[73] Assignee: Mobil Oil Corporation, New York, N.Y.

[21] Appl. No.: 139,216

[22] Filed: Dec. 29, 1987

[51] Int. Cl.[4] ..... F21B 43/26

[52] U.S. Cl. ..... 166/281; 166/308

[58] Field of Search ..... 166/281, 308

[56] References Cited

U.S. PATENT DOCUMENTS

| | | | |
|---|---|---|---|
| 3,613,789 | 10/1971 | Son, Jr. | 166/281 |
| 3,933,205 | 1/1976 | Kiel | 166/281 X |
| 4,005,750 | 2/1977 | Shuck | 166/308 |
| 4,005,753 | 2/1977 | Schettel et al. | 166/308 X |
| 4,157,116 | 6/1979 | Coulter | 166/281 X |
| 4,718,490 | 1/1988 | Uhri | 166/281 |

*Primary Examiner*—William P. Neuder

*Attorney, Agent, or Firm*—Alexander J. McKillop; Charles J. Speciale; Charles A. Malone

[57] ABSTRACT

A process for creating multi-azimuth fractures by hydraulically fracturing a formation via a single wellbore where a special polymer is used as the fracturing fluid. An induced fracture is formed and a solidifiable gel material is injected into the fracture which is allowed to solidify. Thereafter, hydraulic fracturing with the special polymer is repeated causing the fracture trajectory to form contrary to the far-field in-situ stresses.

4 Claims, 1 Drawing Sheet

CREATION OF MULTI-AZIMUTH PERMEABLE HYDRAULIC FRACTURES

FIELD OF THE INVENTION

This invention relates to the ability to control the direction of hydraulic fracture propagation in a subsurface formation by hydraulically fracturing the formation in a sequential manner in combination with plugging material. In hydrocarbon-bearing formations, this could significantly increase well productivity and reservoir cumulative recovery, especially in naturally fractured reservoirs.

BACKGROUND OF THE INVENTION

Hydraulic fracturing is well established in the oil industry. In conventional hydraulic fracturing as practiced by industry, the direction of fracture propagation is primarily controlled by the present orientation of the subsurface ("in-situ") stresses. These stresses are usually resolved into a maximum in-situ stress and a minimum in-situ stress. These two stresses are mutually perpendicular (usually in a horizontal plane) and are assumed to be acting uniformly on a subsurface formation at a distance greatly removed from the site of a hydraulic fracturing operation (i.e., these are "far-field"in-situ stresses). The direction that a hydraulic fracture will propagate from a wellbore into a subsurface formation is perpendicular to the least principal in-situ stress.

The direction of naturally occurring fractures, on the other hand, is dictated by the stresses which existed at the time when that fracture system was developed. As in the case of hydraulic fractures, these natural fractures form perpendicular to the least principal in-situ stress. Since most of these natural fractures in a given system are usually affected by the same in-situ stresses, they tend to be parallel to each other. Very often, the orientation of the in-situ stress system that existed when the natural fractures were formed coincides with the present-day in-situ stress system. This presents a problem when conventional hydraulic fracturing is employed.

When the two stress systems have the same orientation, any induced hydraulic fracture will tend to propagate parallel to the natural fractures. This results in only poor communication between the wellbore and the natural fracture system and does not provide for optimum drainage of reservoir hydrocarbons.

Coulter, in U.S. Pat. No. 4,157,116, issued June 5, 1979 teaches a method for reducing fluid flow from and to a subterranean zone contiguous to a hydrocarbon producing formation which includes the steps of initially extending a common fracture horizontally into the zone and into the formation to locate a portion of the fracture in the zone and the formation. A porous bed of solid particles is then introduced into that portion of the fracture located in the zone. A removable diverting material, such as a gel, is thereafter introduced into the portion of the fracture located in the formation and adjacent the locus of the bed of solid particles to block the portion of the fracture occupied by the diverting material to a selected fluid sealing material. The selected sealing material is introduced to the interstices of the particles in the porous bed, and is set to a fluid-impermeable seal to impede fluid flow to and from said zone. The diverting material is subsequently removed to facilitate hydrocarbon production from the formation.

Dill et al. in U.S. Pat. No. 4,527,628 issued July 9, 1985 teach a method of temporarily plugging a subterranean formation using a diverting material comprising an aqueous carrier liquid and a diverting agent comprising a solid azo compound having an azo component and a methylenic component.

Therefore, what is needed is a method whereby the direction of hydraulic fracture propagation can be diverted dendritically so as to cut into a natural fracture system and link it to the wellbore in order to increase hydrocarbon productivity and cumulative recovery.

SUMMARY OF THE INVENTION

This invention is directed to a method for the creation of multi-azimuth permeable hydraulic fractures in a subterranean formation containing desired resources. In the practice of this invention, said subterranean formation is hydraulically fractured via applying pressure sufficient therefor on at least one wellbore which causes at least one vertical fracture to form. Thereafter, a plugging material such as a solidifiable gel is directed into the created fracture. This material is allowed to solidify.

Another fracture is formed by placing hydraulic pressure sufficient to fracture the formation onto the wellbore. Because the previously induced fracture has been plugged, the second fracture is diverted around the plugged fracture. The steps of plugging, hydraulically fracturing the formation, and diverting the subsequently created fracture, are continued until branched or dendritic fractures are caused to emanate into the formation from the wellbore. In this manner, multi-azimuth permeable hydraulic fractures are created whereby at least one branch intersects at least one natural fracture system connected to the desired resources and the wellbore.

It is therefore an object of this invention to locally alter in-situ stress conditions and divert dendritically the direction that sequentially induced hydraulic fracture will propagate around a plugging material.

It is another object of this invention to locally alter in-situ stress conditions and generate sequential hydraulic fractures which form dendritically around a plugging material and cut into a natural fracture system and connect at least one fracture to the wellbore.

It is yet another object of this invention to increase hydrocarbon production from a subsurface hydrocarbon-bearing formation via sequential hydraulic fracturing around plugging material placed into the formation.

It is still yet a further object of this invention to obtain more effective hydraulic fracturing results under different subsurface in-situ stress conditions by diverting dendratically hydraulic fractures into a natural fracture system containing desired resources.

DESCRIPTION OF THE PREFERRED EMBODIMENTS

In the practice of this invention, hydraulic fracturing is initiated at one well in a formation containing desired resources. A hydraulic fracturing technique is discussed in U.S. Pat. No. 4,067,389, issued to Savins on Jan. 10, 1978. This patent is hereby incorporated by reference. Another method for initiating hydraulic fracturing is disclosed by Medlin et al. in U.S. Pat. No. 4,378,845 which issued on Apr. 5, 1983. This patent is also incorporated by reference. As is known to those skilled in the art, in order to initiate hydraulic fracturing in the formation, the hydraulic pressure applied must exceed the formation pressures in order to cause a fracture to form. The fracture which forms will generally run perpendicular to the least principal stress in the formation or reservoir.

Figure 1:
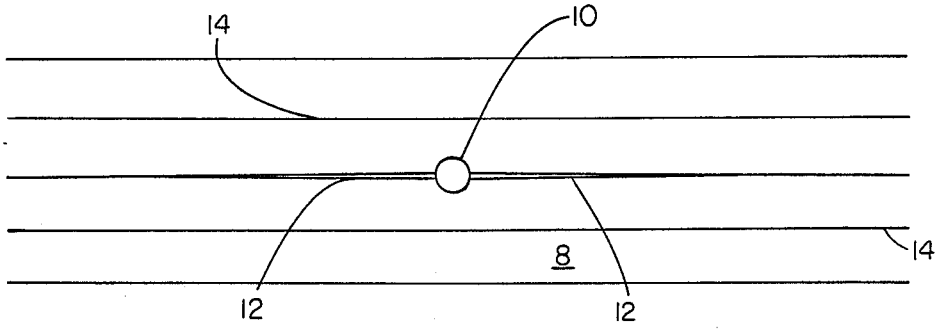
FIG. 1 is a topical view of a double winged vertical fracture induced into the formation by hydraulic fracturing.

A topical view of a hydraulically induced fracture appears in FIG. 1. As shown, double winged vertical fractures 12 emanate from wellbore 10. These fractures propagate parallel to the principal in-situ stresses in formation 8.

Figure 2:
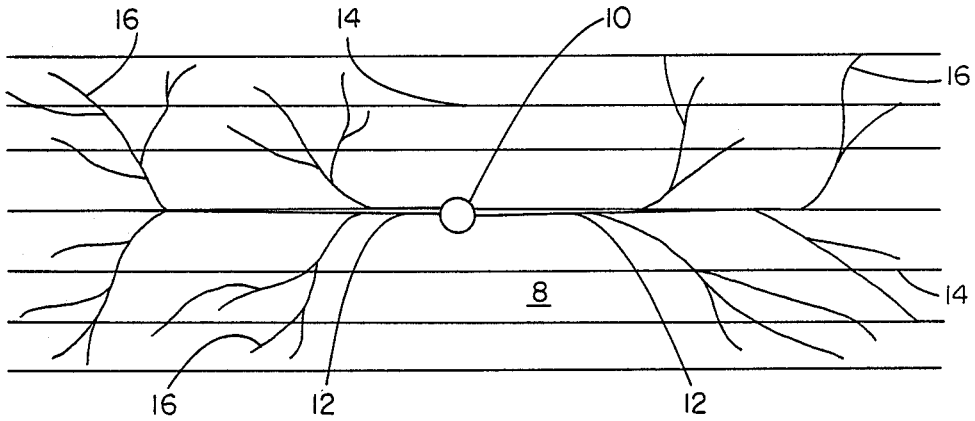
FIG. 2 is a topical view of a double winged vertical fracture induced into the formation by hydraulic fracturing whereby dendritic fractures are formed diverting subsequent fractures around a plugging material.

In the practice of this invention as shown in FIG. 2, a double winged hydraulic fracture 12 has been induced via wellbore 10 into formation 8 containing a desired resource. The induced fracture 12 can be propped by means known to those skilled in the art should it be desired or advantageous. After the fracture has been completed to the extent desired, pressure is released and a material capable of plugging formed fracture 12 is directed down wellbore 10 into formation 8. Once the plugging material is in place and sufficient to plug the fracture at a desired distance, hydraulic fracturing is again induced into the formation. The hydraulic fracturing pressure is sufficient to fracture the formation 8 and is diverted around the plugged portion of the formation thereby forming at least one branched fracture 16.

The pressure on formation 8 is again released and a plugging material is directed down wellbore 10 into formation 8. This plugging material forms a temporary plug or barrier in the branched fracture 16 and a desired portion of fracture 12. Thereafter, hydraulic fracturing is again induced by applying a pressure on formation 8 through wellbore 10. This induced pressure causes at least one other branched fracture to form. Upon repetition of the above procedures, a series of dendritic or branched features form to create multi-azimuth permeable fractures. Plugging agents which can be used herein are discussed in U.S. Pat. No. 4,157,116 which issued to Coulter on June 5, 1979. This patent is incorporated herein by reference.

Once fractures have been generated sufficiently to intersect a natural hydrocarbonaceous bearing formation, the temporary blocking agents are allowed to degenerate either by chemical or physical means. Some undergo releasing or breaking after a given time interval, or upon certain post-use treatment. For example, in U.S. Pat. No. 3,818,990, a breakable gel is placed into the formation. This patent is hereby incorporated by reference. Per this procedure, flow direction can be controlled so as to have dendritic fractures intersect at least one natural formation system communicating with desired resources. After the gel has been removed from the fractures within the formation, the desired resources can be produced therefrom via fractures connected with the wellbore. It is often necessary to create multiple vertical fractures in a formation to recover desired resources therefrom. This is necessary because often the formation is not as permeable as is desired. This invention, as disclosed below, can be utilized in many applications in addition to removing hydrocarbonaceous fluids from a formation.

One such application is for facilitating the removal of ores from a formation containing same. Sareen et al. in U.S. Pat. No. 3,896,879, disclose a method for increasing the permeability of a subterranean formation penetrated by at least one well which extends from the surface of the earth into the formation. This method comprises the injection of an aqueous hydrogen peroxide solution containing therein a stabilizing agent through said well into the subterranean formation. After injection, the solution diffuses into the fractures of the formation surrounding the well. The stabilizing agent reacts with metal values in the formation which allows the hydrogen peroxide to decompose. The decomposition of hydrogen peroxide generates a gaseous medium causing additional fracturing of the formation. Sareen et al. were utilizing a method for increasing the fracture size to obtain increased removal of copper ores from a formation. This patent is hereby incorporated by reference. Utilization of the present invention will increase permeability by creating additional fractures.

In addition to removing ores, particularly copper ores and iron ores from formation, the present invention can be used to recover geothermal energy more efficiently by the creation of more fractures. A method for recovering geothermal energy is disclosed in U.S. Pat. No. 3,863,709 which issued to Fitch on Feb. 4, 1975. This patent is hereby incorporated by reference. Disclosed in this patent is a method and system for recovering geothermal energy from a subterranean geothermal formation having a preferred vertical fracture orientation. At least two deviated wells are provided which extend into the geothermal formation in a direction transversely of the preferred vertical fracture orientation. A plurality of vertical features are hydraulically formed to intersect the deviated walls. A fluid is thereafter injected via one well into the fractures to absorb heat from the geothermal formation and the heated fluid is recovered from the formation via another well.

The present invention can also be used to remove thermal energy produced during in situ combustion of coal by the creation of additional fractures. A method wherein thermal energy so produced by in situ combustion of coal is disclosed in U.S. Pat. No. 4,019,577 which issued to Fitch et al. on Apr. 26, 1977. This patent is hereby incorporated by reference. Disclosed therein is a method for recovering thermal energy from a coal formation which has a preferred vertical fracture orientation. An injection well and a production well are provided to extend into the coal formation and a vertical fracture is formed by hydraulic fracturing techniques. These fractures are propagated into the coal formation to communicate with both the wells. The vertical fracture is propped in the lower portion only. Thereafter, a combustion-supporting gas is injected into the propped portion of the fracture and the coal is ignited. Injection of the combustion-supporting gas is continued to propagate a combustion zone along the propped portion of the fracture and production gases generated at the combustion zone are produced to recover the heat or thermal energy of the coal. Water may also be injected into the fracture to transport the heat resulting from the combustion of the coal to the production well for recovery therefrom. Both the injection and production wells can be deviated wells which penetrate said coal formation in a direction transversely of the preferred fracture orientation.

Recovery of thermal energy from subterranean formations can also be used to generate steam. A method for such recovery is disclosed in U.S. Pat. No. 4,015,663 which issued to Strubhar on Apr. 5, 1977. This patent is hereby incorporated by reference.

Although the present invention has been described with preferred embodiments, it is to be understood that modifications and variations may be resorted to without departing from the spirit and scope of this invention, as those skilled in the art would readily understand.

What is claimed is:

1. A process for creating multi-azimuth fractures via hydraulic fracturing in a subterranean formation containing at least one wellbore comprising:

(a) applying a hydraulic fracturing pressure into the formation through a liquid in said wellbore which pressure is sufficient to fracture said formation thereby forming at least one vertical fracture;

(b) releasing said pressure and directing into said wellbore a solidifiable gel material sufficient to form a temporary plug within a desired time and distance within said formation;

(c) allowing said solidifiable gel material to form a plug within said vertically created fracture; and (d) applying thereafter into said formation through a liquid in said wellbore a pressure sufficient to propagate at least one dendritic fracture from the existing vertical fracture because of the temporary plug in said fracture which dendritic fracture intersects a natural fracture system.

2. The process as recited in claim 1 where in step (b) said plugging material comprises a solidifiable gel material which gel material breaks within about 0.5 to 24 hours.

3. The process as recited in claim 1 where steps (b), (c) and (d) are repeated until multi-azimuth fractures are created in said formation.

4. The process as recited in claim 1 where said formation contains a subterranean resource such as iron, copper ore, uranium ore, geothermal heat, coal, oil shale, or hydrocarbonaceous fluids.

* * * * *

UNITED STATES PATENT AND TRADEMARK OFFICE

CERTIFICATE OF CORRECTION

PATENT NO. : 4,834,181

DATED : May 30, 1989

INVENTOR(S) : Duane C. Uhri et al

It is certified that error appears in the above-identified patent and that said Letters Patent is hereby corrected as shown below:

Column 3, line 43, "features" should read --fractures--.

Column 4, line 35, "walls" should read --wells--.

Column 4, line 58, insert --hot-- before "production".

Signed and Sealed this

Thirtieth Day of October, 1990

*Attest:*

HARRY F. MANBECK, JR.

*Attesting Officer*

*Commissioner of Patents and Trademarks*